US005143263A

United States Patent [19]

Newell

[11] Patent Number: 5,143,263

[45] Date of Patent: Sep. 1, 1992

[54] SPRAY DISPENSER HAVING A NON-USE STORAGE RECESS FOR A DISCHARGE TUBE

[76] Inventor: Arthur E. Newell, 500 Danbury Ln., Topeka, Kans. 66606

[21] Appl. No.: 730,489

[22] Filed: Jul. 16, 1991

[51] Int. Cl.[5] ..... B05B 15/06; B65B 83/14

[52] U.S. Cl. ..... 222/538; 222/95; 222/105; 222/386.5; 222/402.1

[58] Field of Search ..... 222/402.1, 538, 530, 222/540, 533, 534, 95, 105, 183, 386.5

[56] References Cited

U.S. PATENT DOCUMENTS

| | | | |
|---|---|---|---|
| 3,216,628 | 11/1965 | Fergusson | 222/402.1 |
| 3,472,457 | 10/1969 | McAvoy | 222/402.1 X |
| 4,387,833 | 6/1983 | Venus, Jr. | 222/95 |
| 4,805,814 | 2/1989 | Allen, Sr. | 222/538 |
| 4,819,838 | 4/1989 | Hart, Jr. | 222/538 |
| 4,858,792 | 8/1989 | deLaforcade | 222/538 X |
| 4,964,540 | 10/1990 | Katz | 222/95 |
| 4,972,973 | 11/1990 | Davis | 222/538 X |

FOREIGN PATENT DOCUMENTS

| | | | |
|---|---|---|---|
| 2909449 | 9/1980 | Fed. Rep. of Germany | 222/215 |
| 8402056 | 2/1985 | Netherlands | 222/538 |
| 1205629 | 9/1970 | United Kingdom | 222/402.24 |

*Primary Examiner*—Kevin P. Shaver

*Attorney, Agent, or Firm*—Litman, McMahon & Brown

[57] ABSTRACT

A fluid dispensing apparatus includes inner and outer containers and close and extended actuators. The outer container includes a channel which receives the extension actuator in a stored position thereof. Pairs of retainers project inwardly into an outer portion of the channel for retaining the extension actuator in its stored position and can be spread apart to release the extension actuator.

14 Claims, 1 Drawing Sheet

SPRAY DISPENSER HAVING A NON-USE STORAGE RECESS FOR A DISCHARGE TUBE

BACKGROUND OF THE INVENTION

1. Field of the Invention

The present invention relates generally to fluid dispensing, and in particular to a fluid dispensing apparatus with a valve actuator having an extension tube and a container body with a channel receiving the extension tube with the actuator in a stored position thereof.

2. Description of the Related Art

Various fluids are stored in and dispensed from containers which are configured to meet the requirements of particular applications. For example, aerosol spray dispensing systems commonly use metal containers with propellants expelling the fluid contained therein. However, such propellants can raise environmental concerns and add to the expense of the packaged products that they expel. Fluid containers can also be provided with hand-actuated pump mechanisms for dispensing the contents thereof Still further, fluid dispensing systems are available which comprise inner and outer containers, with the inner container being mechanically pressurized by a rubber sleeve for expelling the contents therefrom. This latter type of container has the advantage of automatically dispensing its contents upon actuation of an appropriate valve mechanism without releasing any propellants which might have potential adverse environmental consequences.

Various spray patterns may be desired for dispensed liquids. For example, relatively wide spray patterns are preferred for covering large areas at close range. The dispensing mechanisms can also be provided with extension tubes for delivering liquids to smaller areas which are more difficult to reach. Aerosol type containers have been provided with tubes for attachment to their spray nozzles, which tubes can be fastened to the container sides by tape, rubber bands, etc.

However, heretofore there has not been available a liquid dispensing apparatus including a container with an extension tube receptacle having the advantages and features of the present invention.

SUMMARY OF THE INVENTION

In the practice of the present invention, a fluid dispensing apparatus is provided which includes inner and outer container assemblies, a valve mechanism fluidically communicating with the inner container assembly, a close actuator for mounting on the container assemblies and actuating said valve mechanism, and an extension actuator for mounting on the container assemblies and actuating the valve mechanism. The extension actuator includes an extension tube which is selectively receivable in a channel formed in a sidewall of the outer container for storage. The actuators are interchangeable.

OBJECTS AND ADVANTAGES OF THE INVENTION

The objects and advantages of the present invention include: providing a dispensing apparatus; providing such an apparatus which includes an extension actuator; providing such an apparatus which includes a container having a channel for receiving the extension tube actuator in a stored position thereof; providing such an apparatus which is adaptable to various sizes of containers for various types of liquids; providing such an apparatus for interchangeable actuators; an providing such an apparatus which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
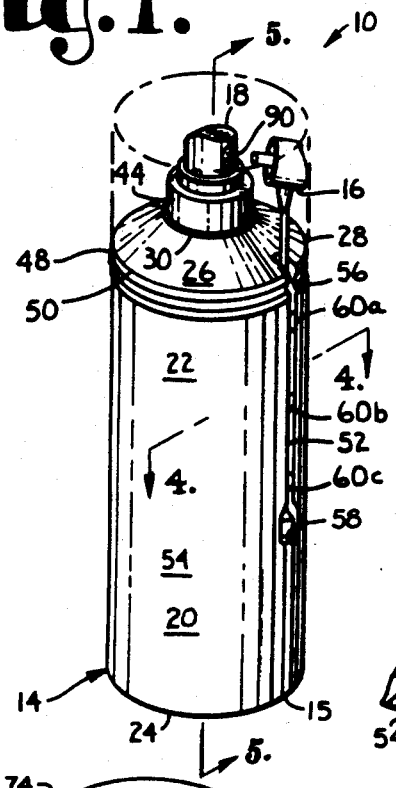
FIG. 1 is an upper, frontal, left side perspective view of a fluid dispensing apparatus embodying the present invention, with an extension actuator thereof shown in a stored position.
Figure 3:
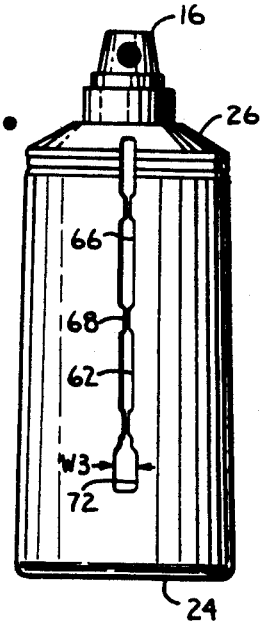
FIG. 3 is a front elevational view thereof.
Figure 4:
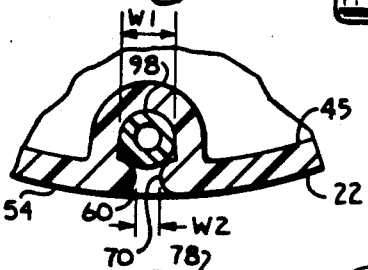
FIG. 4 is an enlarged, fragmentary, horizontal cross-sectional view thereof, taken generally along line 4—4 in FIG. 1.
Figure 2:
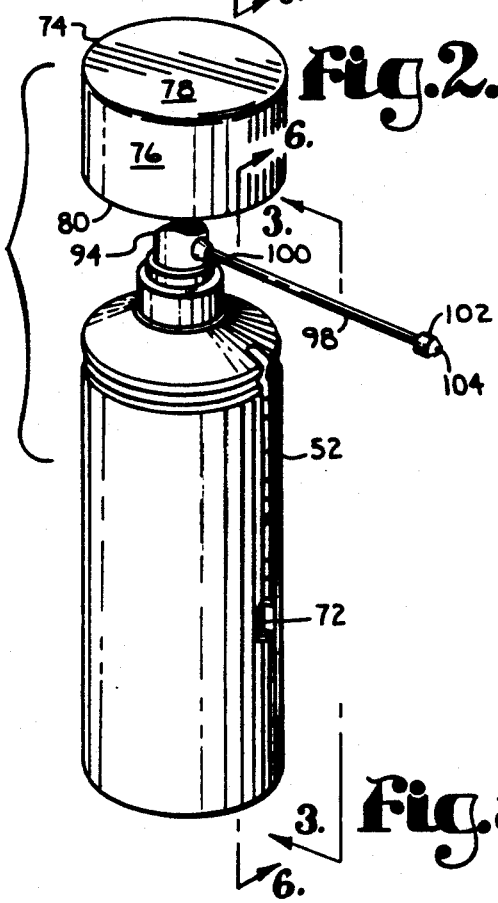
FIG. 2 is an upper, frontal, left side perspective view thereof with the extension actuator in a mounted, use position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 10 generally designates a fluid dispensing container embodying the present invention and adapted for dispensing a fluid 12.

The fluid dispensing apparatus 10 generally comprises a container assembly 14, an extension actuator 16 and a close actuator 18.

II. Container 14

The container assembly 14 includes a generally cylindrical outer bottle or container 15 having a body 20 with a generally cylindrical sidewall 22, a closed bottom 24, a top 26 with a perimeter 28 intersecting the sidewall 22, a neck 30 and a neck opening 32.

Without limitation on the generality of useful applications of the fluid dispensing apparatus 10, the embodiment shown includes fluid dispensing means 34 comprising an automatic squeeze system, which is available from Exxel Container, Inc. of 33 Schoolhouse Road, Somerset, N.J. 08873. The fluid dispensing means 34 includes an inner bottle or container 36, which can be formed by pleating and collapsing a conventional, blow-molded PET bottle. The inner bottle or container 36 includes a body 37 which is compressed in a discharged configuration by an elastomeric (e.g., rubber) sleeve 38 which radially compresses and biases same towards its collapsed configuration. The inner bottle or container 36 can be filled with fluid and expanded to its filled configuration, thus radially expanding and sketching the sleeve 38. The inner bottle or container 36 includes a neck 40 which is received in the neck opening 32 and which mounted a suitable valve mechanism 42 for selectively opening the inner bottle 36. The valve mechanism 42 can be of a conventional design, such as the type commonly used for pushbutton aerosol and other liquid sprayers and dispensers. The valve mechanism 42 includes a collar 44, which can be snapfit on the container necks 30, 40.

Various other fluid dispensing means can be utilized in connection with the apparatus 10, such as a conventional aerosol system or a pump spray system for manual actuation by a user.

the outer container body bottom 234 include s an interior 45 which is open at a vent hole 46. The container body 20 includes an annular shoulder 48 formed in the sidewall 22 adjacent to the top permitter 28. The shoulder 48 includes an outwardly-open, annular groove 50.

Receptacle means comprising a sidewall channel 52 is open at an exterior surface 54 at the container body sidewall 22 and includes an upwardly-open upper end 56 open at the container body top 26 and a downwardly-closed lower end 58 positioned in spaced relation above the container bottom 24.

A plurality (e.g., three are shown) of pair of retainers 60, extend inwardly in opposed relation from respective, opposed, parallel channel sidewalls 62. The sidewalls 62 are interconnected by a channel end wall 64 which is outwardly concave. The retainers 60 are placed in upper, intermediate and lower pairs **60*a*, 60*b* and 60*c***.

The channel 52 has an inner portion 66 with a first transverse width W1 and an outer portion 68 with a second transverse width W2, W1 being greater than W2 whereby passages 70 are formed between the 60 in the channel outer portion 68. A receiver portion 72 is formed in the body 20 at the channel lower end 58 with a width W3 which is greater than the width W2. The container assembly 14 includes a cap 74 with a generally cylindrical sidewall 76, a closed upper end 78 and an open lower end 80. Multiple tabs 82 project inwardly from the sidewalls 76 into a cap interior 84 in proximity to the open lower end 80 and are selectively received in the body groove 50. The cap 74 is thus adapted for snapping on and off of the body 20, but screw-on caps and the like could also be employed.

A first, close actuator 18 includes a button 88 adapted for digital engagement. The first actuator 86 includes a lateral orifice 90 communicating with an inlet tube 92 adapted for actuating the valve mechanism 42 and communicating with the lateral orifice 90. The actuator 18 can be of a relatively conventional type commonly utilized on other types of spray apparatus.

The extension actuator 16, like the close actuator 18, includes a button 94 and an inlet tube 96, the inlet tube 96 fluidically communicates with an extension tube 98 with a proximate end 100 connected to the button 94 and an enlarged distal end 102 with an outlet orifice 104. The extension tube 98 can be removable from the button 94.

III. Operation

Figure 5:
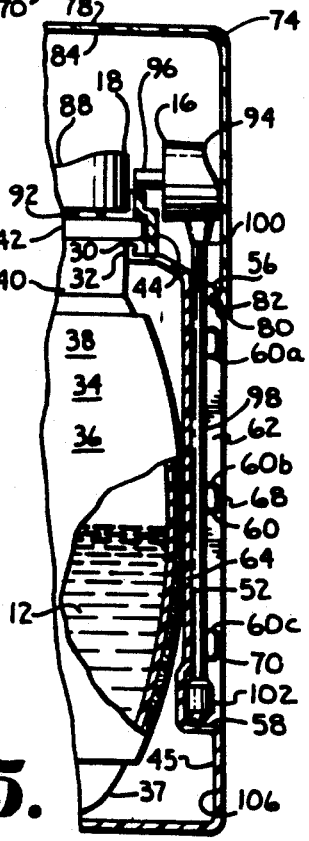
FIG. 5 is an enlarged, fragmentary, vertical, cross-sectional view thereof, taken generally along line 5—5 in FIG. 1.
Figure 6:
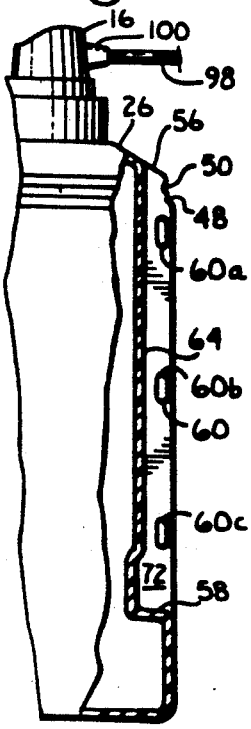
FIG. 6 is an enlarged, fragmentary, side elevational view thereof taken generally along lines 6—6 in FIG. 2.

In operation, the actuators 16 and 18 are interchangeable and are adapted for providing fluid spray and delivery patterns as required for different applications, e.g., close-up and broad spray patterns with the close actuator 18, and stream spray patterns at greater distances and in tight places from the extension actuator 16. The extension actuator 16 can be stored in the channel 52 with its tube 98 received in the channel inner portion 66 and retained by the retainers 60, its enlarged distal 102 received in the channel receiver portion 72, and its actuator button 94 located above the body top 26 for storage within the cap interior 84 (FIG. 5). The actuator tube 98 has a diameter no greater than the channel inner portion width W1, and greater than the channel exterior portion width W2.

The container body 20 can comprise a flexible, polymeric material. The actuator tube 98 can thus be snapped into place in the channel inner portion 66 by pressing it through the channel outer portion 68, thereby spreading the respective retainers 60. As the liquid is dispensed, the vent hole balances the air pressure in an interstitial space 106 between the inner and outer containers 36, 15 and an ambient air pressure.

The outer container body 20 can be molded from a suitable polymer with the requisite flexibility for expanding and contracting the passages 70 when the extension actuator 16 is inserted and removed. The container body 20 can be formed in various sizes and lengths, and the extension actuator 16 can likewise be provided in various lengths and with various outlet orifice 104 configurations for achieving appropriate spray and stream patterns of the fluid.

With the cap 74 in place, the fluid dispensing apparatus 10 is relatively compact, and its extension actuator 16 is substantially enclosed without protruding from the outer surface of the fluid dispensing apparatus 10 whereby packaging and handling of the fluid dispensing apparatus 10 and storage of the extension actuator 16 are facilitated. In particular, the extension actuator 16 can be relatively securely stored in the container body 20 during nonuse, and will not interfere with the operation of the fluid dispensing apparatus 10 with the close actuator 18.

It is to be understood that while certain forms of the present invention have been illustrated and described herein, it is not to be limited to the specific forms or arrangement of parts described and shown.

What is claimed and desired to be secured by Letters Patent is as follows:

1. A fluid dispensing apparatus, which comprises:

(a) a container with a body having a generally cylindrical sidewall, a bottom, an interior at least partially enclosed by said sidewall and said bottom, an exterior surface, a top and a neck having an opening communicating with said interior;

(b) dispensing means for dispensing fluid from the container through the neck thereof;

(c) actuator means for mounting on said body neck and for actuating the dispensing means, said actuator means being removable from a use position on said body neck and including an actuator extension tube;

(d) receptacle means formed in said body for selectively receiving said actuator extension tube;

(e) said receptacle means comprising a channel extending longitudinally along and open at said body exterior surface; and (f) said channel terminating at a downwardly-closed lower end in spaced relation above said container body bottom and at an upwardly-open upper end at said container top wall.

2. The invention of claim 1 wherein:

(a) said channel includes an inner portion with a first transverse width and an outer portion forming a passage with a second transverse width; and (b) said second width is less than said first width.

3. The invention of claim 2, which includes:

(a) said channel having a pair of opposed sidewalls and an end wall, said sidewalls being positioned in substantially parallel, spaced relation and interconnected by said channel end wall; and (b) retainer means projecting inwardly from one of said channel sidewalls and forming said lesser-width channel outer portion.

4. The invention of claim 1 wherein:

(a) said actuator means comprises an actuator button with means for mounting on said neck in fluidic communication with said dispensing means and an actuator extension tube including a proximate end attached to said actuator button in fluidic communication therewith and a distal end.

5. The invention of claim 4 wherein:

(a) said tube has a diameter no greater than said channel inner portion width and greater than said channel outer portion width; and (b) said container comprises a flexible material.

6. The invention of claim 5, which includes:

(a) a plurality of pairs of retainers, each pair of retainers extending in opposed relation from said channel sidewalls and forming said channel outer portion therebetween.

7. The invention of claim 1 wherein:

(a) said extension tube includes an enlarged distal end with an outlet orifice; and (b) said channel lower end has a receiver portion at said channel lower end and said receiver portion has a third width greater than said channel first width, said receiver portion at said channel lower end being adapted for receiving said extension tube enlarged distal end.

8. The invention of claim 1, which includes:

(a) said container comprising an outer container; and (b) said fluid dispensing means comprising an inner container including an inner container body positioned within said outer container body and an inner container neck positioned within said outer container neck opening.

9. The invention of claim 8 wherein:

(a) said inner container includes a body expandable and collapsible between expanded and collapsed configurations; and (b) a resilient, elastomeric sleeve receiving said inner container body and biasing same towards its collapsed configuration.

10. The invention of claim 4, which includes:

(a) said actuator means comprising a first actuator means;

(b) a second actuator means including an actuator button with an outlet orifice and an inlet tube communicating with said outlet orifice and selectively communicating with said container body interior; and (c) said first and second actuators means being interchangeably mounted on said container body in fluidic communication with said container body neck.

11. The invention of claim 10, which includes:

(a) valve means mounted in the neck opening and having an open position fluidically communicating one of said actuators and said container interior and a closed position.

12. The invention of claim 11 wherein:

(a) each said actuator includes an inlet tube selectively receivable in said valve means in fluidic communication with said container body interior.

13. The invention of claim 1 wherein:

(a) said container comprises a polymeric material.

14. A fluid dispensing apparatus, which comprises:

(a) an outer container including:

(1) a body having a generally cylindrical sidewall, a bottom and a top having a perimeter at said sidewall;

(2) said outer container top having a neck with an opening;

(3) an annular shoulder in said sidewall adjacent to said top perimeter, said shoulder having an outwardly-open, annular groove;

(4) a channel extending longitudinally along and open at said sidewall, said channel having an upwardly-open upper end open at said outer container top and a downwardly-closed lower end located in spaced relation above said container bottom;

(5) said channel having an inner portion with a first transverse width;

(6) said channel having a pair of opposed, substantially parallel sidewalls and an outwardly-concave end wall interconnecting said sidewalls;

(7) multiple pairs of retainers extending in opposed relation from respective channel sidewalls;

(8) said channel having an outer portion between said opposed pairs of tabs and a plurality of passages each formed between a respective pair of tabs at said channel outer portions, said channel having a second transverse width at said outer portion thereof, said channel second transverse width being less than said channel first transverse width;

(9) a channel receiver portion at said channel lower end, said channel receiver portion having a third transverse channel width which is greater than said first channel transverse width;

(10) an outer container interior;

(11) said bottom having a vent hole; and

(12) a cap including a generally cylindrical sidewall, a closed upper end, an open lower end, an interior and a plurality of tabs extending radially inwardly from said sidewall into said interior in proximity to said lower end, said cap having an installed position on said outer container with said cap tabs received in said outer container groove;

(b) inner container including:

(1) a body positioned generally within said outer container interior;

(2) a neck positioned generally within said outer container neck opening;

(3) an elastomeric sleeve receiving said inner container body;

(4) an expanded, filled position expanded radially outwardly;

(5) a collapsed configuration with said sleeve contracted radially inwardly; and (6) said sleeve including means for biasing said inner container from its filled, expanded position to its collapsed position;

(c) a valve mechanism mounted on said inner container neck in fluidic communication with said inner container, said valve mechanism having open and closed positions;

(d) a collar mounted on said outer container neck and receiving said valve mechanism;

(e) a close actuator including a button receivable in said collar, a lateral orifice and an inlet tube fluidically communicating with said lateral orifice and said valve mechanism;

(f) an extension actuator including a button received in said collar, an inlet tube, an extension tube fluidically communicating with said inlet tube and extending laterally from said button, said extension tube having a proximate end connected to said button and an enlarged distal end having a discharge orifice;

(g) said close and extension actuators being interchangeably mountable on said container necks with their respective inlet tubes being received in and fluidically communicating with said valve mechanism; and (h) said extension actuator having a stored position with the extension tube thereof generally positioned within said channel inner portion and the enlarged, distal end thereof positioned within the channel receiver portion and the button thereof generally positioned within the cap interior with the cap installed on the outer container.

* * * * *